United States Patent [19]

Mizushima et al.

[11] 4,427,917

[45] Jan. 24, 1984

[54] TELEVISION CAMERA TUBE WITH ELECTROSTATIC FOCUSING

[75] Inventors: Masashi Mizushima, Shizuoka; Shigeru Ehata, Mobara; Masanori Maruyama; Masakazu Fukushima, both of Kokubunji, all of Japan

[73] Assignee: Hitachi, Ltd., Tokyo, Japan

[21] Appl. No.: 416,916

[22] Filed: Sep. 13, 1982

Related U.S. Application Data

[63] Continuation of Ser. No. 160,203, Jun. 17, 1980, abandoned.

[30] Foreign Application Priority Data

Jun. 22, 1979 [JP] Japan ..... 54-78210

[51] Int. Cl.[3] ..... H01J 31/26; H01J 29/74; H01J 29/46

[52] U.S. Cl. ..... 313/389; 313/390; 313/414; 313/439; 313/449; 313/460

[58] Field of Search ..... 313/389, 390, 449, 439, 313/414, 460

[56] References Cited

U.S. PATENT DOCUMENTS 3,866,079 2/1975 Schut ..... 313/390 X
3,995,194 11/1976 Blacker, Jr. et al. ..... 313/449 X
4,169,239 9/1979 Ehata et al. ..... 313/460 X
4,178,532 12/1979 Fukuzawa et al. ..... 313/449 X

FOREIGN PATENT DOCUMENTS 50150287 6/1977 Japan ..... 313/389
1340077 12/1973 United Kingdom ..... 313/389

OTHER PUBLICATIONS

Shichiri, "18 mm0 Electrostatic Focusing Camera Tube 20PE19", Toshiba Review, No. 117, Sep.-Oct. 1978, (313-389).

*Primary Examiner*—Eugene R. LaRoche
*Assistant Examiner*—Vincent De Luca
*Attorney, Agent, or Firm*—Antonelli, Terry & Wands

[57] ABSTRACT

A television camera tube with electrostatic focusing comprising a triode section at the first stage having a cathode a first grid and a second grid, an electrostatic focusing lens section at the next stage having a third, fourth and fifth grids of cylindrical electrode configuration, and a sixth grid with mesh electrode configuration at the last stage, these electrodes being coaxially arranged in a cylindrical glass envelope, the length of the fourth grid is greater than 1.15 times the inner diameter thereof but equal to or smaller than 2.30 times the inner diameter thereof.

12 Claims, 10 Drawing Figures

TELEVISION CAMERA TUBE WITH ELECTROSTATIC FOCUSING

This is a continuation of application Ser. No. 160,203, filed June 17, 1980, abandoned.

This invention relates to a television camera tube with electrostatic focusing and more particularly to the electrode structure of an electrostatic focusing lens for such a television camera tube.

First, the structure and the basic operation of a conventional television camera tube with electrostatic focusing will be briefly described. FIG. 1 shows in longitudinal section the structure of a camera tube with electrostatic focusing and electro-magnetic deflection such as a vidicon, which is an example of a camera tube with electrostatic focusing. In FIG. 1, reference numeral 1 designates a cylindrical glass envelope, in which a photoconductive target 2 is disposed at the front end and a plurality of lead pins 3 are provided, passing through the rear end wall. The glass envelope contains various electrodes arranged coaxially or concentrically and high vacuum is established in the glass envelope. Numeral 5 designates a cathode, and numerals 6 and 7 respectively indicate first and second grids for controlling the electron current, the converging angle and the cross-sectional area of an electron beam emitted from the cathode 5. An electron-beam limiting electrode 8 having a small aperture (beam limiting diaphragm) 8*a* is disposed at the side of the second grid 7 near the photoconductive target 2 so as to provide a narrowly defined electron beam. The cathode 5, the first grid 6 and the second grid 7 constitute a triode section of the electron gun. Numerals 9, 10 and 11 indicate third, fourth and fifth grid electrodes of cylindrical shape, which constitute an electrostatic focusing lens section for focusing the diverging electron beam through the aperture 8*a* of the second grid 7 from the triode section onto the surface of the target 2 with a small spot. Numeral 12 designates a sixth grid electrode with mesh configuration interposed between the fifth grid 11 and the target 2. The fifth and sixth grids 11 and 12 form a collimation lens for casting the electron beam always perpendicularly onto the target 2. Numeral 13 indicates an electromagnetic deflection coil mounted on around the glass envelope 1 for deflecting the beam for scanning. With this type of camera tube, the electron beam emanating from the triode section is focused on the target 2 by means of the electrostatic focusing lens section and the sixth grid or mesh electrode 12 while the electron beam is deflected by the electromagnetic deflection coil 13, whereby the target 2 is scanned by the beam to produce a video signal. Namely, when an optical image is formed on the photoconductive target 2, the distribution of potential corresponding to the optical image is developed over the surface of the target 2. Upon incidence of the electron beam, the potential at the point of incidence is reduced to about zero. At this time, a discharging current flowing through the electrostatic capacitance of the target 2 is read out as a video signal.

Next, the electrostatic focusing lens section consisting of the third, fourth and fifth grid 9, 10 and 11 will be described in detail. FIG. 2 shows in longitudinal section the principal part or electrostatic focusing lens section of the camera tube shown in FIG. 1. As shown in FIG. 2, the third grid 9 is a stepped cylindrical electrode which has interconnected upper and lower cylindrical portions 9*b* and 9*a* whose inner diameters are different.

The inner diameter $d'_3$ of the lower portion 9*a* is shown to be smaller than the inner diameter $d_3$ of the upper portion 9*b*. The fourth grid 10 is a cylindrical electrode having its one end overlapping the end of the upper portion 9*b* of the third grid 9 with a predetermined radial gap defined therebetween, the inner diameter $d_4$ of the fourth grid 10 being greater than the inner diameter $d_3$ of the upper portion 9*b* of the third grid 9. The fifth grid 11 is also a stepped cylindrical electrode which has interconnected upper and lower cylindrical portions 11*b* and 11*a*, the lower portion 11*a* of the fifth grid 11 having its inner diameter $d_5$ larger than the inner diameter $d_4$ of the fourth grid 10 and the upper portion 11*b* of the grid 11 having its inner diameter $d'_5$ larger than the inner diameter $d_5$ of the lower portion 11*a*. The end of the lower portion 11*a* of the fifth grid 11 overlaps the other end of the fourth grid 10 with a predetermined radial gap defined therebetween. Also, in FIG.2, reference numerals 8, 8*a* and 12 respectively indicate the above-mentioned electron beam limiting electrode, the beam limiting aperature and the sixth grid. The long-and-short dash line 20 in FIG. 2 corresponds to the bulb axis. The typical dimensions for the third, fourth and fifth cylindrical grid electrodes 9, 10 and 11 in the conventional $\frac{2}{3}$ inch type camera tube is as follows: The length $l_3$ of the third grid 9 is about 25.4 mm, the inner diameter $d'_3$ of the lower portion 9*a* being about 7.6 mm and the inner diameter $d_3$ of the upper portion 9*b* about 9.6 mm; the length $l_4$ of the fourth grid 10 is about 12.0 mm, the inner diameter $d_4$ thereof being about 10.4 mm; and the length $l_5$ of the fifth grid 11 is about 24.4 mm, the inner diameter $d_5$ of the lower portion 11*a* being about 11.6 mm and the inner diameter $d'_5$ of the upper portion 11*b* about 12.4 mm. Usually, DC voltages of 500 V, 70~ 80 V and 300 V are applied respectively to these grid electrodes 9, 10 and 11. The sixth grid 12 is applied with a DC voltage of 500 V. The cathode 5, the first grid 6 and the second grid 7 are applied with 0 V, −100~0 V and 300 V respectively, As seen from FIG. 2, $l_3$, $l_4$ and $l_5$ represents the effective lengths of the grids 9, 10 and 11. Namely, $l_3$ gives the length of the third grid 9 along the axis of the glass envelope, ranging from an end 21 at the side of the beam limiting electrode 8 to an end 22 at the side of the fourth grid 10; $l_4$ the length of the fourth grid 10 measured from the end 22 of the third grid 9 to an end 23 of the fourth grid 10 at the side of the fifth grid 11 along the axis of the glass envelope; and $l_5$ the length of the fifth grid 11 measured from the end 23 of the fourth grid 10 to an end 24 of the fifth grid 11 at the side of the sixth grid 12 along the envelope axis.

Resolution is one important factor to evaluate the performance of a camera tube. The resolution of a camera tube is closely related to the diameter of the electron beam cast on the photoconductive target and the smaller is the beam diameter, the higher is the resolution. However, the minimum beam diameter attainable by convergence is limited by the distribution of initial velocities of electrons emitted from the cathode (i.e. the initial-velocity spread of thermionic emission), the space charge effect and the aberrations of the focusing lens system. In the case of the above-described camera tube with electrostatic focusing, the density of current carried by the electron beam through the electrostatic lens section is low so that the extent of spreading of the electron beam due to the space charge effect is not so large. Thus, the spreading of the beam due to both the distribution of velocity of thermionic emission and the aberration of the electrostatic lens system are predominant. Accordingly, so far as the above-described camera tube with electrostatic focusing is concerned, it is necessary, for the purpose of obtaining a satisfactory resolution, to design the structure of the electrodes constituting the electrostatic focusing lens section in such a manner that the spreading of the electron beam due to the above-mentioned two factors is minimized. However, it has hitherto been almost impossible to exactly grasp the behavior of an electron beam in the electrostatic focusing lens and therefore to completely understand the cause-and-effect relationship between the electrode structure of the electrostatic focusing lens and the spreading of the electron beam. For this reason, the structure of the electrodes constituting the electrostatic lens section could not always be optimized in view of maximizing the resolution.

An object of this invention is to provide a camera tube with electrostatic focusing having an excellent resolution by optimizing the dimensions of electrodes constituting an electrostatic focusing lens.

In accordance with this invention, which has been made to attain the above object, the ratio of the length $l_4$ of the fourth grid to the inner diameter $d_4$ thereof in the electrostatic focusing lens is selected to satisfy $1.15 < l_4/d_4 \leqq 2.30$.

This invention will now be described in conjunction with the accompanying drawings, in which.

This invention has been made on the basis of the fact that spreading divergence of an electron beam could be quantitatively determined by analyzing the relationship among the structure of electrodes constituting an electrostatic lens section, the aberration and the magnification through a computer simulation and that the optimal structure of electrodes for the electrostatic focusing lens section could be derived from the results of such analysis.

Figure 1:
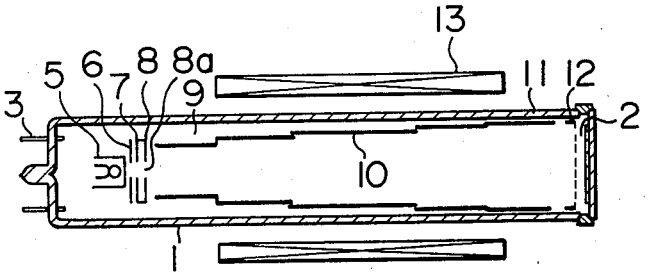
FIG. 1 PRIOR ART
FIG. 1 shows in longitudinal section a conventional television camera tube with electrostatic focusing and electromagnetic deflection.
Figure 2:
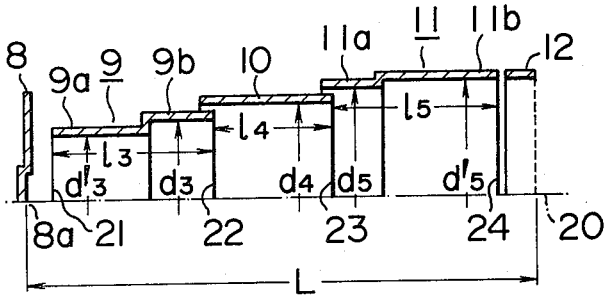
FIG. 2 PRIOR ART
FIG. 2 shows in detail the electrostatic focusing lens section of the television camera tube shown in FIG. 1.

This invention will be described in detail through the reference to an electrostatic focusing lens section having such a structure as shown in FIG. 2. In the following explanation, the voltages to be applied to various electrodes assume the values exemplified in conjunction with the above-described conventional camera tube.

First, the spreading of an electron beam due to spherical aberration will be described. In a camera tube with electrostatic focusing, the greatest diameter of the electron beam within the axial length of the electrostatic focusing lens is about 10% of the inner diameter of the fourth grid 10 and therefore it is only necessary to regard the aberration of the electrostatic lens as spherical aberration of the third degree. Here, the spreading of the electron beam due to the spherical aberration, that is, the diameter $D_C$ of a disk of least confusion is related to the spherical aberration coefficient $C_{SP}$ as follows:

$$D_C = \tfrac{1}{2} M_L \cdot C_{SP} \cdot \theta^3 \tag{1}$$

Here, $M_L$ is the magnification of the electrostatic focusing lens and $\theta$ the divergence angle of the electron beam at the electron beam limiting aperture 8*a*. As seen from the relation (1), the diameter $D_C$ of the disk of least confusion is proportional to the spherical aberration coefficient $C_{SP}$. For the evaluation of the aberration characteristic of an electrostatic focusing lens section with the focal distance kept constant, therefore, the diameter $D_C$ of the disk of least confusion may be used.

Figure 3:
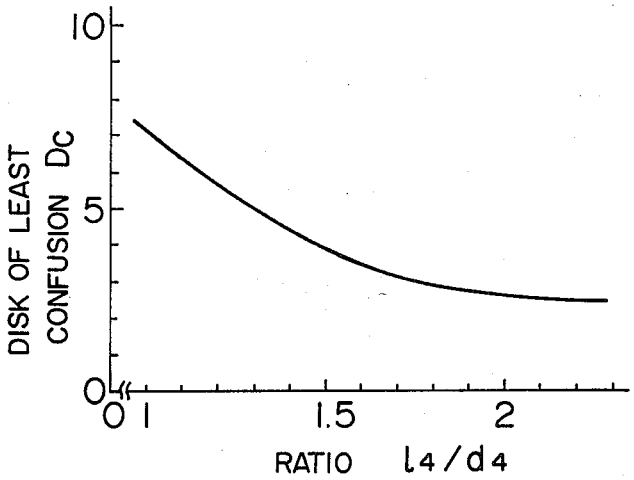
FIG. 3 shows the relationship between the length-to-diameter ratio of the fourth grid and the disk of least confusion.

FIG. 3 shows the relationship between the diameter $D_C$ of the disk of least confusion (arbitrary unit) and the ratio $l_4/d_4$ of the effective length $l_4$ of the fourth grid 10 to the inner diameter $d_4$ thereof, which has been obtained through a computer simulation. In this case, the total length L of the electrostatic lens system (i.e. the distance from the electron beam limiting aperture 8*a* to the mesh portion of the sixth grid 12) is kept constant. It is apparent from FIG. 3 that the diameter $D_C$ of the disk of least confusion decreases with the increase in the ratio $l_4/d_4$ and that the diameter $D_C$ of the disk of least confusion (or the spreading of the electron beam due to spherical aberration) in the case of the ratio $l_4/d_4 \geqq 1.60$ can be reduced to about a half of that in the case of the ratio $l_4/d_4 = 1.15$ which corresponds to the above-mentioned conventional electrostatic focusing lens.

Next, description will be given of the spreading of the electron beam due to the distribution of initial velocity of thermionic emission. This spreading of the beam can be calculated from the noted Langmuir's equation which relates the cathode condition to the density of current carried by the focused electron beam such that $$\rho_S = \rho_C\left(1 + \frac{eV}{kT}\right) \sin^2 (M_A\theta) \tag{2}$$

where $\rho_S$ is the current density of the focused electron beam, $\rho_C$ the current density of the electron beam at the exit of the beam limiting aperture 8*a*, V the electric potential at the focal point (i.e. the sixth grid 12), $M_A$ the angular magnification of the electrostatic lens section, T the temperature of the cathode, e the charge of an electron, and k the Boltzmann's constant. Further, by approximating the distribution of the current density $\rho_S$ of the beam at the focal point by a rectangular profile, the spreading $D_L$ of the beam due to the initial-velocity distribution of thermionic emission is represented by the following relation:

$$D_L = 2\sqrt{\frac{i_B}{\pi\rho_S}} \simeq 2\sqrt{\frac{kTi_B}{eV\pi\rho_C}} \cdot \frac{1}{M_A\theta} \tag{3}$$

where $i_B$ is the beam current within the electrostatic focusing lens and $\pi$ the circular constant. It is seen from the relation (3) that the spreading $D_L$ in question varies in inverse proportion to the angular magnification factor $M_A$ of the electrostatic focusing lens section.

Figure 4:
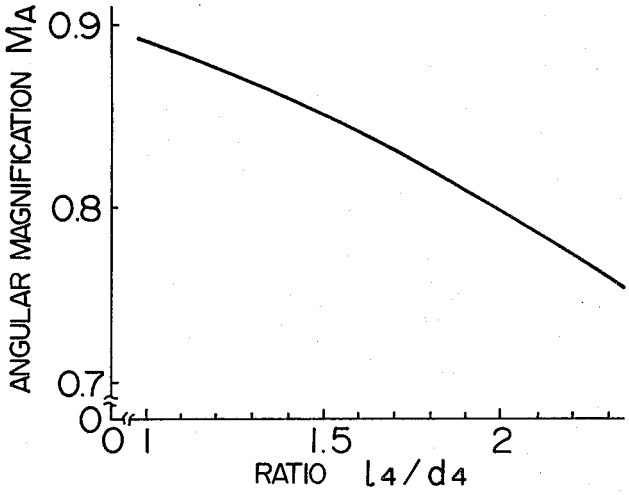
FIG. 4 shows the relationship between the length-to-diameter ratio of the fourth grid and the angular magnification.

FIG. 4 shows the relationship between the ratio $l_4/d_4$ and the angular magnification $M_A$, which has been obtained through a computer simulation. As apparent from FIG. 4, the angular magnification $M_A$ gradually falls as the ratio $l_4/d_4$ increases. For example, $M_A$ is about 0.79 when $l_4/d_4$ is 2.10 while $M_A$ in the case of the conventional electrostatic focusing lens with $l_4/d_4$ equal to 1.15 is about 0.88.

Figure 5:
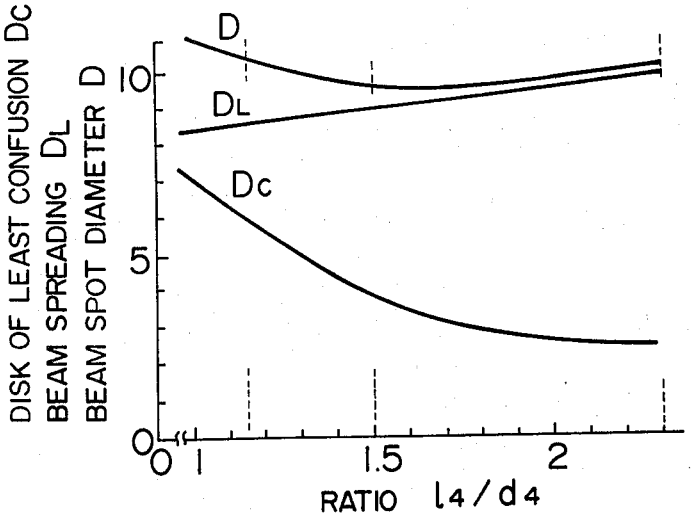
FIG. 5 shows the relationship among the length-to-diameter ratio of the fourth grid, the disk of least confusion of the focusing lens system, the spreading of an electron beam due to the initial-velocity distribution of thermionic emission and the diameter of the electron beam.

FIG. 5 shows the variations of the diameter $D_C$ of the disk of least confusion and the spreading $D_L$ of the beam calculated from the relation (3), with the ratio $l_4/d_4$ of length to diameter of the fourth grid 10.

It can be understood from the relation (3) that the current density $\rho_C$ of the electron beam at the cathode should be made as large as possible to diminish the spreading $D_L$ of the beam due to the initial-velocity distribution thermionic emission. However, the increase in the current density $\rho_C$ causes the shortening of the lifetime of the cathode and therefore the current density $\rho_C$ cannot be made too large. In the case of an oxide cathode used usually in an ordinary camera tube, the optimal current density $\rho_C$ is $0.2 \sim 0.5 A/cm^2$. As for the divergence angle $\theta$ of the electron beam, it should be made as large as possible, as apparent from the relation (3), to decrease the spreading $D_L$ of the beam due to the initial-velocity distribution of thermionic emission. As seen from the relation (1), however, the increase in the divergence angle $\theta$ results in a considerable increase in the diameter $D_C$ of the disk of least confusion. Therefore, the divergence angle $\theta$ is determined by balancing $D_L$ with $D_C$, that is, usually settled to be approximately 1°. The spreading $D_L$ of the beam due to the initial-velocity of thermionic emission shown in FIG. 5 is calculated from the relation (3) on the assumption that a typical triode section is used wherein the current density $\rho_C$ is 0.38 $A/cm^2$ and the divergence angle $\theta$ is 1.37 degree, for the beam current $i_B$ of 2.4 $\mu$A.

From FIG. 5, it is apparent that when $l_4/d_4$ increases, $D_C$ gradually decreases while $D_L$ gently increases. FIG. 5 also shows the spot diameter D of the beam which is defined by the square root of the sum of the squares of $D_C$ and $D_L$, i.e. $\sqrt{D_C^2+D_L^2}$. As evident from FIG. 5, the beam spot diameter D takes its minimum value when $l_4/d_4$ is about 1.5 and this minimum value is smaller by 9% than the beam spot diameter within the electrostatic lens section having the conventional dimensions, i.e. $l_4/d_4=1.15$. Therefore, the most excellent electrostatic focusing lens section is obtained if the effective length $l_4$ of the fourth grid 10 is set equal to 1.50 times its inner diameter $d_4$, that is, if $l_4=1.50\ d_4$. More concretely, the dimensions of the third, fourth and fifth grids of a $\frac{2}{3}$ inch camera tube are such that $l_3=22.8$ mm, $l_4=15.6$ mm and $l_5=21.8$ mm. The inner diameters of these grid electrodes and the voltages applied thereto are the same as those for the conventional example described before. Further, even if the range of choice of the effective length $l_4$ is extended such that $1.15\ d_4<l_4\leqq 2.30\ d_4$, the beam spot diameter D in this case still remains smaller than the beam spot diameter in the conventional electrostatic lens so that the desired object of this invention is attained.

Figure 6:
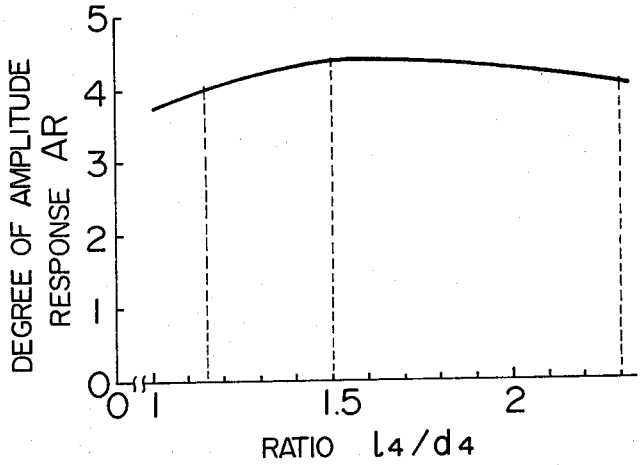
FIG. 6 shows the relationship between the length-to-diameter ratio of the fourth grid and the resolution.
Figure 7A:
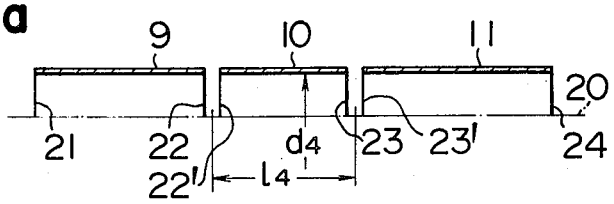
FIGS. 7*a* to 7*d* show other examples of a unipotential focusing (UPF) type electrostatic lens.
Figure 7B:
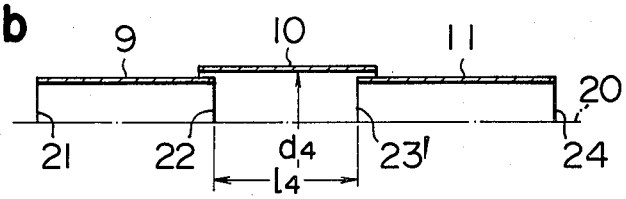
Figure 7C:
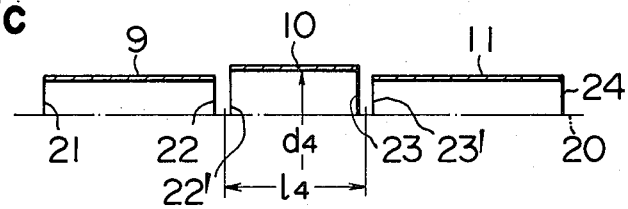
Figure 7D:
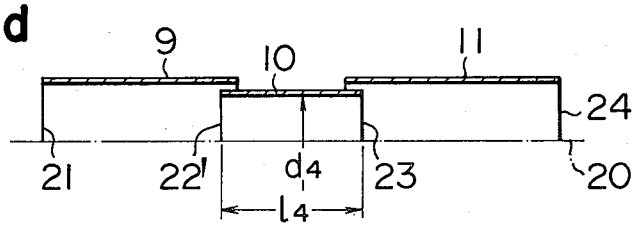

FIG. 6 shows a summary of resolutions measured of various electrostatic focusing and electromagnetic deflection camera tube samples in which the lengths $l_4$ of their fourth grids are different. The abscissa represents the ratio $l_4/d_4$ of length $l_4$ to inner diameter $d_4$ of the fourth grid and the ordinate is the resolution represented as the degree of amplitude response AR (arbitrary unit) with respect to a vertical line pattern having a special frequency of 400 TV lines. In view of the fact that the reciprocal of the beam diameter D corresponds to the resolution, it will be understood that the dependence of the measured resolution AR on $l_4/d_4$ shown in FIG. 6 matches the calculated beam spot diameter D shown in FIG. 5 and therefore that the adequacy of the above choice of the optimal dimensions associated with an electrostatic focusing lens section is verified.

As described above, according to this invention, there can be provided an electrostatic focusing camera tube having a higher resolution.

In the preceding description, the electrostatic focusing lens has been referred to as having such a stepped-electrode structure as shown in FIG. 2. However, this invention is not limited to this electrode structure but may be applied to any electrode structure so long as it is the unipotential focusing (UPF) type. Other typical electrode structures of a UPF type electrostatic lens are shown in FIGS. *7a* to *7d*. In those figures and FIG. 2, the equivalent parts are designated by the same reference numeral. In the structure shown in FIG. *7a*, the inner diameters of the third, fourth and fifth grids have the same value. The effective length $l_4$ of the fourth grid 10 is the distance measured along the envelope axis from the middle point between the end 22 of the third grid 9 and one end 22' of the fourth grid 10 to the middle point between the other end 23 of the fourth grid 10 and the end 23' of the fifth grid 11. In the structures shown in FIGS. *7b* and *7c*, the inner diameter $d_4$ of the fourth grid 10 is greater than the inner diameters of the third and fifth grids 9 and 11. In FIG. *7b*, the opposite ends of the fourth grid 10 overlap the end 22 of the third grid 9 and the end 23' of the fifth grid 11 respectively. In FIG. *7c*, the grids 9, 10 and 11 are separated along the envelope axis from each other. In FIG. *7b*, the effective length $l_4$ of the fourth grid 10 is defined as the distance from the end 22 of the third grid 9 to the end 23' of the fifth grid 11 along the envelope axis. In FIG. *7c*, the effective length $l_4$ of the fourth grid 10 is defined, similar to the case in FIG. *7a*, as the distance along the envelope axis from the middle point between the end 22 of the third grid 9 and one end 22' of the fourth grid 10 to the middle point between the other end 23 of the fourth grid 10 and the end 23' of the fifth grid 11. In the structure shown in FIG. *7d*, the inner diameter of the fourth grid 10 is chosen to be smaller than those of the third and fifth grids 9 and 11. The effective length $l_4$ of the fourth grid 10 is defined as the distance from one end 22' of the grid 10 to the other end 23 thereof along the bulb axis. The above-described electrode structures have been proposed from the technical point of view in the electrode fabrication process and the differences in structure have no appreciable effect on the resolution characteristic. Moreover, this invention can also be applied to the above-described electrostatic lens combined with an electromagnetic focusing lens for effecting a general focusing function.

What is claimed is:

1. A television camera tube with electrostatic focusing in which an optical image is projected onto a photoconductive target to develop thereover the distribution of potential corresponding to the optical image and this photoconductive target is scanned by an electron beam to produce an electrical signal corresponding to the optical image, said television camera tube comprising:

an electron beam emitting section including cathode means and grid means for generating an electron beam;

said photoconductive target;

an electrostatic focusing lens including cylindrical electrode means disposed between said electron beam emitting section and said photoconductive target for focusing the electron beam from said electron beam emitting section onto said photoconductive target, said cylindrical electrode means having first, second and third cylindrical electrodes coaxially arranged in the mentioned order from the side of the said electron beam emitting section, means for applying to said first cylindrical electrode a first voltage greater than a third voltage which is applied to said third cylindrical electrode, means for applying to said second cylindrical electrode a second voltage smaller than said third voltage, said second cylindrical electrode satisfying the relation of $1.20 < l_4/d_4 \leqq 2.30$, $l_4$ and $d_4$ being the length and inner diameter of said second cylindrical electrode; and a collimation lens including mesh electrode means disposed between said electrostatic focusing lens and said photoconductive target for casting the focused electron beam from said electrostatic focusing lens perpendicularly onto said photoconductive target.

2. A television camera tube according to claim 1, wherein the inner diameters of said first and third cylindrical electrodes are slightly smaller and greater than the inner diameter $d_4$ of said second cylindrical electrode, respectively.

3. A television camera tube according to claim 2, wherein each of said first and third cylindrical electrodes includes two interconnected cylindrical electrode portions whose inner diameters are slightly different.

4. A television camera tube according to claims 2 or 3, wherein said second cylindrical electrode has its opposite ends overlapping one end of said first cylindrical electrode and one end of said third cylindrical electrode.

5. A television camera tube according to claim 1, wherein each of the inner diameters of said first and third cylindrical electrodes are substantially the same as the inner diameter $d_4$ of said second cylindrical electrode.

6. A television camera tube according to claim 1, wherein the inner diameters of said first and third cylindrical electrodes are equal to each other and are slightly smaller than the inner diameter $d_4$ of said second cylindrical electrode.

7. A television camera tube according to claim 6, wherein said second cylindrical electrode has its opposite ends overlapping one end of said first cylindrical electrode and one end of said third cylindrical electrode.

8. A television camera tube according to claim 1, wherein the inner diameters of said first and third cylindrical electrodes are equal to each other and are slightly greater than the inner diameter $d_4$ of said second cylindrical electrode.

9. A television camera tube according to claim 8, wherein said second cylindrical electrode has its opposite ends extending beyond one end of said first cylindrical electrode and one end of said third cylindrical electrode.

10. A television camera tube according to claim 1, further including means for applying a predetermined voltage to said mesh electrode means, and wherein said first voltage applied to said first cylindrical electrode is equal to the voltage which is applied to said mesh electrode means.

11. A television camera tube according to claim 1, wherein said third voltage applied to said third cylindrical electrode is equal to a voltage which is applied to said grid means of said electron beam emitting section.

12. A television camera tube according to claim 1, wherein $l_4/d_4$ is 1.50.

* * * * *